United States Patent [19]

de Bourbon

[11] Patent Number: 5,067,923

[45] Date of Patent: Nov. 26, 1991

[54] TRAINING SYSTEM FOR SPINNING OBJECTS BY HAND

[76] Inventor: Lou de Bourbon, 428 Anacapa St., Santa Barbara, Calif. 93101

[21] Appl. No.: 499,002

[22] Filed: Mar. 26, 1990

[51] Int. Cl.[5] ..... A63H 1/00; A63H 27/00; G09B 19/00; A63B 65/10

[52] U.S. Cl. ..... 446/236; 446/46; 434/258; 273/424

[58] Field of Search ..... 446/236, 240, 242, 243, 446/255, 265, 266, 46, 47, 48; 273/424, 425; 434/258, 260

[56] References Cited

U.S. PATENT DOCUMENTS

| | | | |
|---|---|---|---|
| 3,141,262 | 7/1964 | Burton | 446/240 |
| 3,673,731 | 7/1972 | Farhi et al. | 446/46 |
| 3,813,810 | 6/1974 | Majewski | 446/240 X |
| 3,939,601 | 2/1976 | Kernell | 446/240 |
| 4,096,659 | 6/1978 | Keane | 446/240 |
| 4,356,660 | 11/1982 | O'Brien | 446/46 X |
| 4,681,553 | 7/1987 | Rodarte | 446/46 |
| 4,889,347 | 12/1989 | Mineart | 273/424 |
| 4,940,441 | 7/1990 | Novinsky | 446/46 |

FOREIGN PATENT DOCUMENTS

| | | | |
|---|---|---|---|
| 988715 | 5/1976 | Canada | 446/240 |
| 2187969 | 9/1987 | United Kingdom | 446/46 |

*Primary Examiner*—D. Neal Muir

*Attorney, Agent, or Firm*—Francis X. LoJacono

[57] ABSTRACT

A training device for training and teaching an individual to balance and spin an object such as a plate or platter and the like wherein the training device defines a finger disk that is either formed as an integral part of an object to be balanced and spun or as a separate finger disk unit that is removably attached to an object having a selective configuration. The finger disk is formed having a base member and an annular rim or flange which together define a cavity or depression, the base member and rim being formed with a selective cross-sectional configuration such as a concave depression or a cone-shaped design wherein each specific design configuration provides a different level of skill to operate the device. A recess is also included which is centrally positioned within the cavity or depression wherein one's finger is received therein for spinning the object.

15 Claims, 2 Drawing Sheets

TRAINING SYSTEM FOR SPINNING OBJECTS BY HAND

BACKGROUND OF THE INVENTION

1. Field of the Invention

The present invention relates to a means for training an individual in the art of spinning and balancing an object, such as a platter or the like, on a finger; and it relates more particularly to a training device for spinning an object on top of one's finger, wherein the device provides for a multiplicity of finger disks having different cross-sectional configurations, with at least one finger disk being formed as part of the object or as a separate member adapted to be removably secured to at least one side of an object. Each finger disk is centrally positioned on an object and is designed to be grasped with one hand in order that the object may be spun while being projected into the air; one's finger is then placed within the periphery of the given circular configuration of a finger disk, whereby a suitable object is capable of being spun and balanced about the vertical axis of the individual's finger.

2. Description of the Prior Art

As is well known in the art, various problems and difficulties are encountered in providing suitable means for teaching one the art of spinning objects on a finger. For one to learn such a skill, it takes hard work and many hours of practice. Up to the present there has not been a proper means available to aid in teaching the skills of balancing and spinning an object on one's finger.

However, there are many games that use various devices to spin articles as well as games having particular objects to be spun. Accordingly, the following U.S. patents are of interest:

U.S. Pat. No. 3,575,414 to P. F. O'Brien discloses a wheel, whirl and catch toy which includes a wheel and a control handle supporting a roller. The roller engages the circular periphery of an inner edge of the wheel when rolling the same along the ground or when twirling the same in the air so as to cause the same to be thrown therefrom and recaught thereupon.

U.S. Pat. No. 3,859,748 to W. L. Blue discloses a rotatable toy that comprises a thin, rigid sheet member shaped as a disk having a volute inscribed thereon. An aperture which is sized to accomodate a human finger therethrough is located at the origin of the volute.

In U.S. Pat. No. 4,040,625 to Victor Malafronte there is disclosed a flying disc apparatus that includes a ring secured to a shaft with a roller rotatably mounted on the shaft to permit a flying disc to continue to spin after it has been caught on the apparatus.

There is disclosed in U.S. Pat. No. 4,337,593 to W. J. McAllister an anatomically manipulable rotatable implement which comprises a shaft, a massive body portion rigidly attached to the shaft, and a contact element at one end of the shaft.

In U.S. Pat. No. 4,429,487 to O. Z. Taylor et al there is disclosed a ball whirling toy having an orbital track with a concave/convex cross-section, the concave side of which faces inwardly toward the center of the track circumscribing the orbital track. A handling arrangement is secured to the orbital track whereby, upon insertion of a ball within the track and movement of the track by the handling arrangement, the ball will be caused to move around the inside of the track.

OBJECTS AND ADVANTAGES OF THE INVENTION

It is an object of the present invention to provide a training device for those who wish to learn the art of spinning an object and maintaining it spinning with only an undulatory finger movement, wherein the device is a finger disk that is adaptable in two forms. In one form, the finger disk is arranged as an integral part of an object to be rotated or spun. The other form is constructed as a separate unit that is fixedly attached to an object one might want to use.

Another object of the invention is to provide a training device of this type that allows one to readily learn the skills of spinning and balancing objects having various configurations other than just circular plates and platters, and can even include multistory sheet like objects, as well as rectangular serving trays or books.

Still another object of the present invention is to provide a device of this character that includes a matched set of a multiplicity of finger disks wherein each finger disk of a matched set has a particular cross-sectional configuration so that one can attain several levels of proficiency.

A further object of the invention is to provide a training device of this character that can be used both indoors and outdoors for the development of one's tactile sensitivity and positional awareness, as well as the simultaneous and independent manipulation of objects with each hand.

Still another object of the present invention is to provide a device of this type that is formed as a particularly designed platter wherein the disk is centrally located in the center of an object or on either side thereof, or a pair of disks may be positioned on opposite sides of the object.

Still a further object of the invention is to provide a finger disk that is removably secured to an object whereby one can select a particular disk along with an object having a particular configuration. Thus, the training can be very divergent whereby one's skill level can be continuously increased.

A still further object of the present invention is to provide training disks of the type mentioned above wherein the finger surfaces of the disks vary so as to establish different interacting frictional surface conditions by means of material modifications to the inner disk surface.

It is still another object of the present invention to provide a training disk of this character wherein skill level is determined by the parameters of inner surface smoothness and inclination; rim height and slope; central depression configuration; and overall weight and balance of the object.

The characteristics and advantages of the invention are further sufficiently referred to in connection with the accompanying drawings, which represent one or more embodiments. Variations may be made without departing from the principles disclosed and I contemplate the employment of any structures, arrangements of modes of operation that are properly within the scope of the appended claims.

BRIEF DESCRIPTION OF THE DRAWING FIGURES

With the above and related objects in view, the invention consists in the details of construction and combination of parts, as will be more fully understood from the following description, when read in conjunction with the accompanying drawings and numbered parts in which.

FIGS. 6, 7, 8, and 9 illustrate various designs that may be employed to provide a choice of different levels of skill.

DETAILED DESCRIPTION OF THE INVENTION

Figure 1:
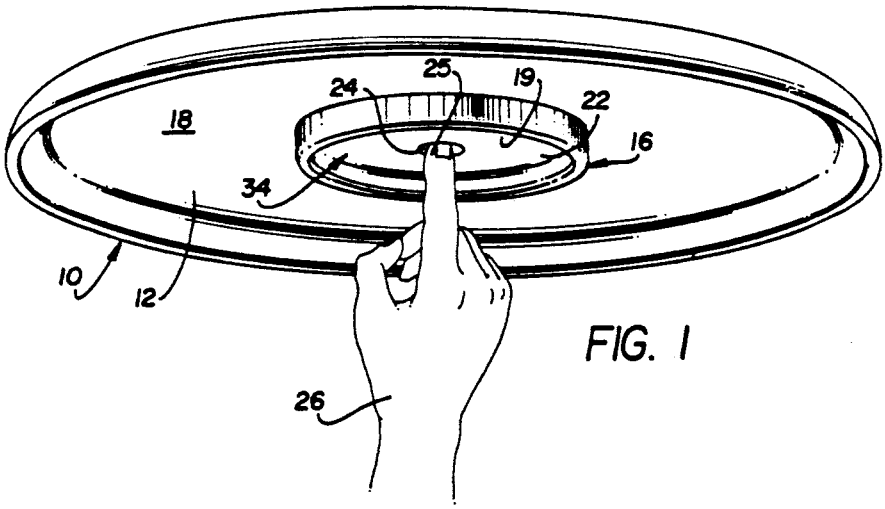
FIG. 1 is a pictorial view of the present invention showing a plate having a finger disk integrally formed thereon with the index finger of a hand being centered in the finger disk.

Referring more particularly to FIG. 1, there is shown a pictorial view of the present invention, generally indicated at 10, which is illustrated as a dish-like object defined by a plate member 12 having an outer peripheral curved edge 14. It should be noted that the dish-like object 10 is for illustrative purposes only and represents many shapes and types of other objects that can be employed in the present invention. Several other suitable objects will hereinafter be disclosed. Plate member 12 is formed having a downwardly projecting finger disk member, designated generally at 16, which is located on the bottom surface 18 of plate member 12. Finger disk 16 is shown in FIG. 1 as being formed as an integral part of plate member 12. It is contemplated that several plates will be provided to define a set of plates wherein each plate will be formed having a particular finger disk. Each disk is designed with a different cross-sectional configuration so as to establish a range of learning skill levels from easy to a more progressively difficult. This is accomplished by arranging different center depressions, slopes, profiles and rim shapes and textures, some of which will hereinafter be described and shown in FIGS. 2 through 5. Accordingly, each finger disk comprises a base 19 and an annular rim 20 that encircles a cavity or a depression formed in the upper wall surface 22 of base 19. The upper wall surface 22 also includes a centrally positioned recess 24 which is adapted to receive finger 25 of the user's hand 26, as illustrated in FIG. 1.

Figure 2:
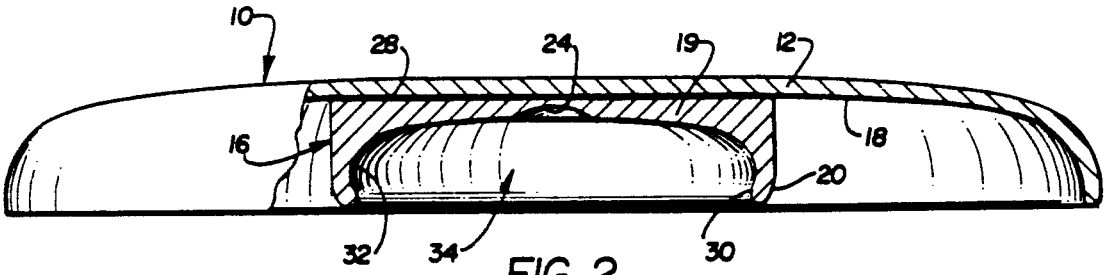
FIG. 2 is a partial cross-sectional view of the plate provided with a removable finger disk.
Figure 3:
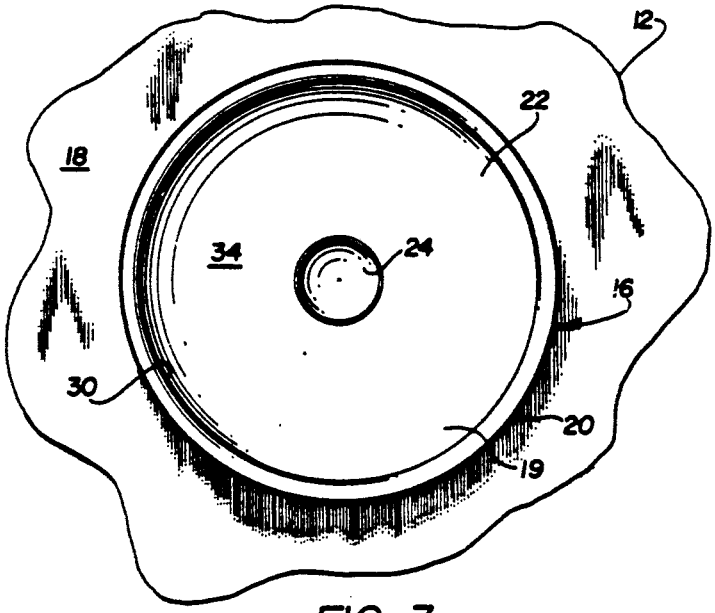
FIG. 3 is a bottom plan view of the disk as seen in FIG. 2.

Referring now to FIGS. 2 and 3, finger disk 16 is shown in cross-section as being removably secured to the bottom surface 18 of the plate by a suitable securing means such as an adhesive or a securing cloth material as indicated at 28. However, screws or snaps are also contemplated even though they are not shown herein. Rim 20 is provided with an inwardly turned lip edge 30 that defines an inner concave annular wall 32 formed in base 19. This inner wall arrangement 32 establishes a means by which the user's finger 25 will be readily restrained within the main cavity 34 of finger disk 16. In this particular configuration the skill level would be considered in the lower range because the upper wall surface 22 of base 19 is formed with a pronounced curved concave surface, the center of which terminates at a centrally positioned finger recess 24.

Figure 4:
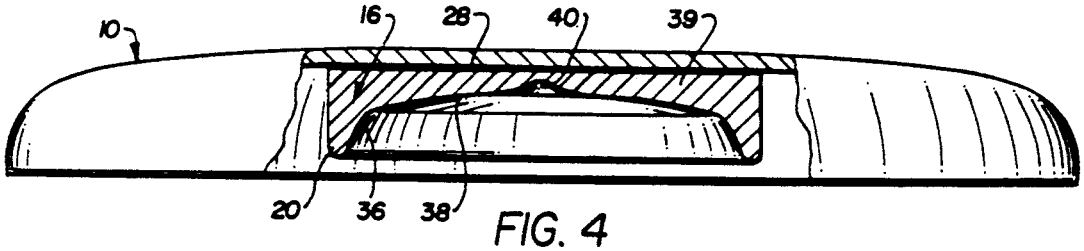
FIG. 4 is another partial view similar to FIG. 2 wherein the finger disk is shown having a different finger surface configuration.

In FIG. 4 there is illustrated a finger disk 16 requiring a higher skill level than the finger disk of FIG. 2. Accordingly, rim 20 is formed with an upwardly sloped wall 36 that blends into the upper wall surface 38 of base 39. Surface 38 is provided with a more gently graded concave configuration than that seen in FIG. 2. The central recess 40 is also changed so as to establish a higher skill level for the user thereof.

Figure 5:
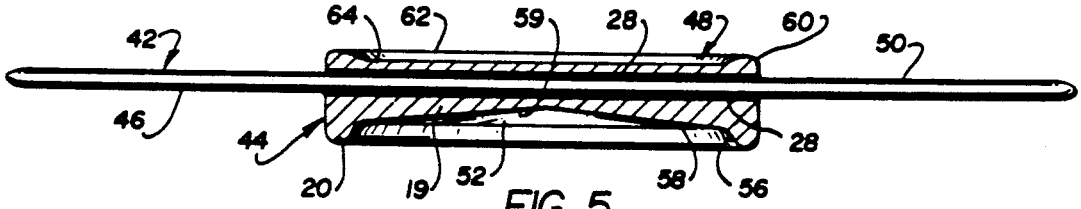
FIG. 5 is a cross-sectional view of a pair of finger disks, each having a different finger surface configuration and wherein the disks are mounted to the opposite sides of the object.

Referring now to FIG. 5, there is shown a platter, generally indicated at 42, which is illustrated as a substantially flat object which can be formed as having one of many different peripheral configurations. Further, in FIG. 5, a dual finger disk arrangement is illustrated wherein there are two different and distinct finger disk units with a first disk 44 being secured to the lower or bottom surface 46 of platter 42, and a second disk 48 being secured to the upper or top surface 50 thereof. This arrangement allows for various suitable objects, such as plates or platters, etc., to be used with a pair of finger disks wherein each disk is formed to provide a particular skill level separate from the others. It should be noted that lower finger disk 44 comprises a shallow cavity 52 defined by rim 20 having a short inclined inner surface 56 and an upper wall surface 58 of base 19. Upper wall surface 58 is formed having a substantially flat inclined configuration that defines a cone-shaped depression wherein the apex 59 thereof establishes the recess for finger 25 to be received therein. Thus, it can be readily understood that as the inclined surface diminishes from one disk to another the skill level increases.

Second finger disk 48 is formed having a rim with a low-profile annular lip 60. Thus, cavity 62 is established by lip 60 and a low-profile flat wall surface 64. A cross-sectional configuration as shown in finger disk 48 would be employed to train one in the spinning and balancing of an object in a high-grade skill level.

Figure 6:
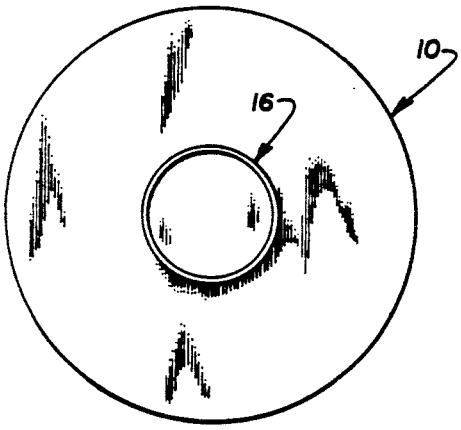
Figure 7:
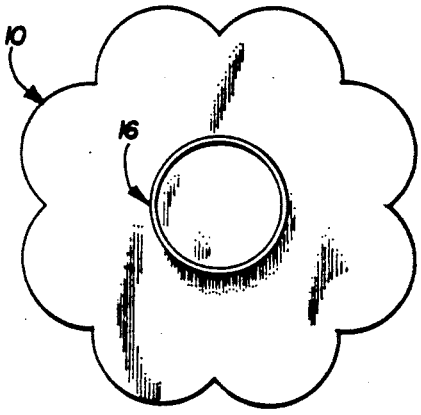
Figure 8:
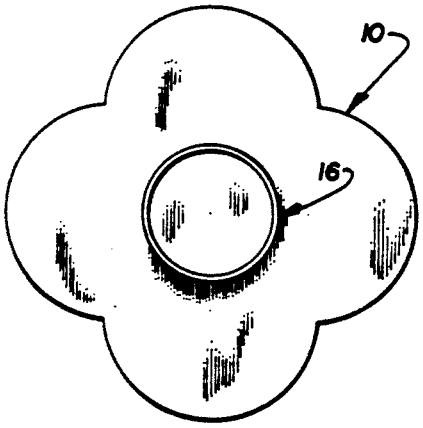
Figure 9:
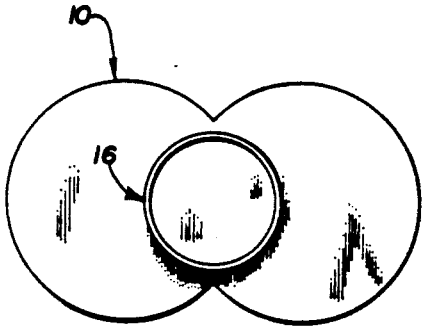

FIG. 6 shows a true circular plate having a finger disk 16 centrally affixed thereto. FIG. 7 shows a balancing plate wherein the peripheral edge thereof is scalloped, as indicated at 65. FIGS. 8 and 9 illustrate two other configurations. One can, therefore, understand that many differently shaped objects together with many different finger disks can be employed by one training in the art of balancing and spinning objects.

It is further contemplated that the inner surface of the cavity, more particularly the surface of the base member of the finger disk, may be formed with a roughened surface so as to provide a suitable traction means whereby one's finger will make a positive engagement with the wall surface of the cavity. The roughened surface may be molded therein or the surface may be impregnated with a suitable material.

The foregoing is a description of several preferred embodiments of the invention which are given here by way of example only. The invention is not to be taken as limited to any of the specific features as described, but comprehends all such variations thereof as come within the scope of the appended claims.

What I claim is:

1. A training system for balancing and spinning an essentially planar object, wherein said system comprises a plurality of interchangeable finger disk members, each removably attachable to said essentially planar object so as to receive a user's finger therein, said system comprising:

each of said plurality of interchangeable finger disk members having a cavity formed therein to receive a finger; wherein each cavity of said plurality of interchangeable disk members is formed having a different cross-sectional configuration that requires a related skill level in order to use; and wherein said finger disk members are formed having a mating base surface a wall surface and a rim, wherein said cross-sectional configuration is defined by said wall surface and said rim, whereby a user selectively changes one finger disk member for another so as to choose one member related to his skill level for balancing and spinning an object to which one of said finger disk members is removably attached; and adhesive means for removably securing one of said finger disk members mating surface to at least one side of a chosen essentially planar object.

2. A training system as recited in claim 1, wherein said rim member defines a lip member depending from said mating surface base and wherein said base includes a centrally positioned recess to receive said finger while said object is spinning thereon.

3. A training system as recited in claim 1, wherein said cross-sectional configuration is defined by a depression formed in said wall surface.

4. A training system as recited in claim 3, wherein said wall surface is formed so as to define a cone-shaped cavity, and wherein the apex defines said recess to receive said finger as said essentially planar object is spinning thereon.

5. A training system as recited in claim 3, wherein said wall surface is formed having a concave configuration.

6. A training system as recited in claim 5, wherein said lip member is formed having a concave inner annular wall surface.

7. A training system as recited in claim 3, wherein said wall surface is formed having an annular sloping curved wall surface terminating at said central recess.

8. A training system as recited in claim 7, wherein said lip member is formed having an upwardly sloping wall surface.

9. A training system as recited in claim 1, wherein said training system includes:

a first finger disk member mounted to one side of said essentially planar object; and a second finger disk member mounted to the opposite side of said essentially planar object wherein each of said finger disk members is formed having a different cross-sectional configuration, whereby each finger disk member requires a different skill level between said first finger disk member and said second finger disk member so as to operate said attached object in a balanced spinning mode.

10. In combination, a training finger disk member mounted to an essentially planar object for balancing and spinning said object on the finger of an individual, said combination comprising:

said object having a selective perimeter configuration;

a multiplicity of interchangeable finger disk members, wherein any one of said finger members is removably mounted to said object and centrally positioned thereon, each of said finger disk members comprising:

an essentially planar mating surface, a wall surface, a rim member; and a cavity defined by said wall surface and said rim member, wherein any one cross-sectional configuration of said wall surface and said rim member requires a related skill level to use which corresponds to that skill level of a user to balance and spin said object; and attachment means removably securing said mating surface to a portion of said essentially planar object.

11. The combination as recited in claim 10, wherein said wall surface includes a centrally positioned recess to receive a user's finger therein while said essentially planar object is spinning thereon.

12. The combination as recited in claim 11, wherein said wall surface is formed with a selective depression, whereby a particular level of operating skill is required.

13. The combination as recited in claim 12, wherein said depression is defined by a concave surface.

14. The combination as recited in claim 12, wherein said depression is defined by a cone-shaped surface.

15. The combination as recited in claim 12 including:

a first finger disk member mounted to one side of said object, the configuration of said depression being formed to require a particular operating skill level; and a second finger disk member mounted to the opposite side of said object, the configuration of said depression thereof being formed requiring a second skill level different from that of the related skill level required by said first finger disk member.

* * * * *